US005542001A

United States Patent [19]

Reiffin

[11] Patent Number: 5,542,001

[45] Date of Patent: Jul. 30, 1996

[54] SMART AMPLIFIER FOR LOUDSPEAKER MOTIONAL FEEDBACK DERIVED FROM LINEARIZATION OF A NONLINEAR MOTION RESPONSIVE SIGNAL

[76] Inventor: Martin Reiffin, 5439 Blackhawk Dr., Danville, Calif. 94506

[21] Appl. No.: 350,429

[22] Filed: Dec. 6, 1994

[51] Int. Cl.[6] ..... H04R 3/00

[52] U.S. Cl. ..... 381/96; 381/194; 381/199

[58] Field of Search ..... 381/96, 98, 159, 381/162, 122, 59, 111, 116, 117, 154; 330/85; 181/160, 153

[56] References Cited

U.S. PATENT DOCUMENTS

| | | | |
|---|---|---|---|
| 4,369,412 | 1/1983 | Sakano | 330/298 |
| 4,379,209 | 4/1983 | Sakano | 381/96 |
| 4,387,270 | 6/1983 | Sakano et al. | 381/96 |
| 4,488,012 | 12/1984 | Matsuda et al. | 381/96 |
| 4,908,870 | 3/1990 | Nagi | 381/59 |
| 5,009,281 | 4/1991 | Yokoyama | 381/96 |
| 5,181,251 | 1/1993 | Schultheics et al. | 381/59 |

*Primary Examiner*—Curtis Kuntz
*Assistant Examiner*—Xu Mei

[57] ABSTRACT

A motional feedback loudspeaker system provides acceptable bass performance even with inexpensive speakers by the reduction of nonlinear distortion with the use of feedback derived from the back emf signal generated by the motion of the voice-coil within the magnet field. A novel linearizing circuit corrects the nonlinearity of the back emf signal due to the falloff of the BL factor as a function of cone displacement. The linearizing circuit is a recursive feedback loop comprising a multiplier for multiplying the back emf signal by a corrective function which is the inverse of the BL nonlinearity so as to provide a velocity signal linearly proportional to the cone velocity, an integrator for integrating the velocity signal to generate a displacement signal linearly proportional to the cone displacement, and a correction generator comprising a nonlinear curve shaper responsive to the displacement signal to generate said corrective function.

27 Claims, 6 Drawing Sheets

OVERALL SYSTEM

OVERALL SYSTEM

LINEARIZING CIRCUIT

CORRECTION GENERATOR

CURVE SHAPER

FIG. 5 - BL FACTOR v. VOICE-COIL DISPLACEMENT
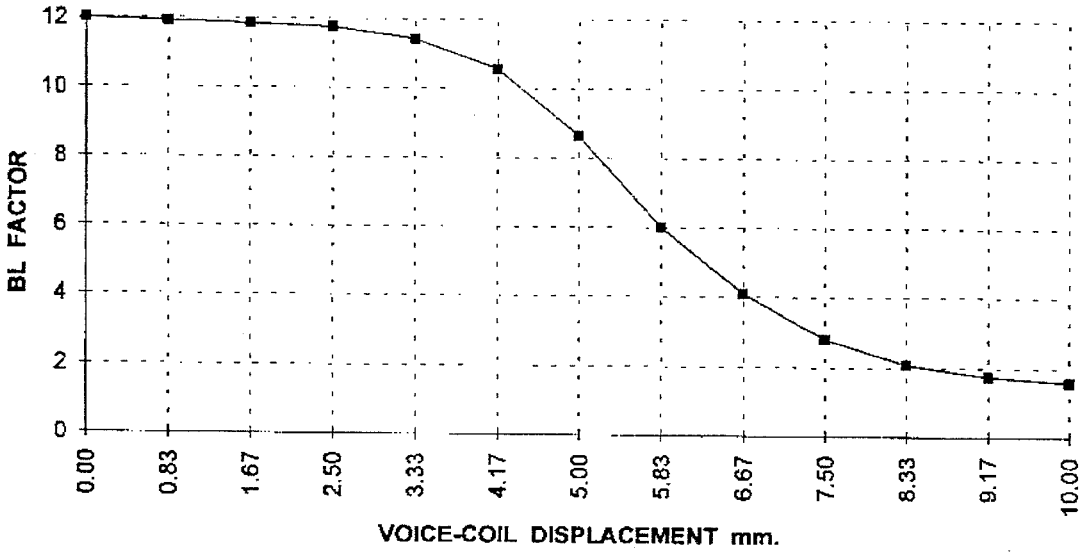
FIG. 6 - DISTORTION FACTOR v. DISPLACEMENT
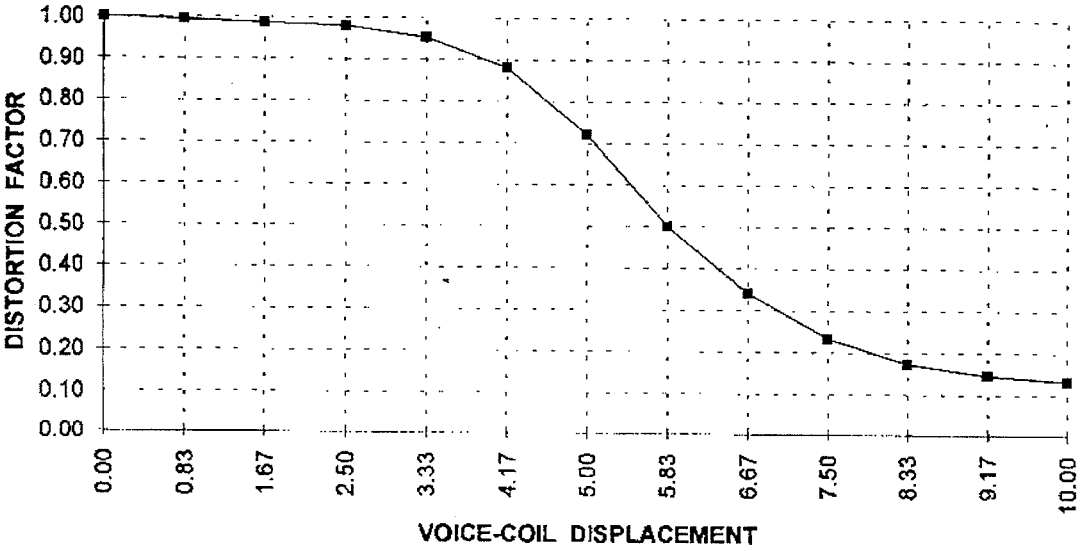

FIG. 7 - CORRECTION FACTOR v. DISPLACEMENT
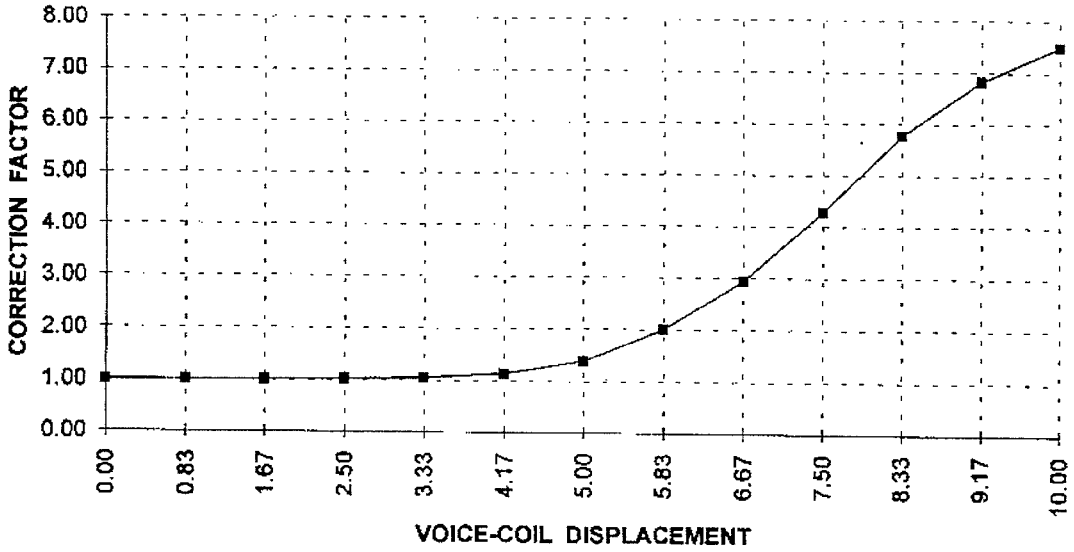
FIG. 8 - CURVE SHAPE v. DISPLACEMENT
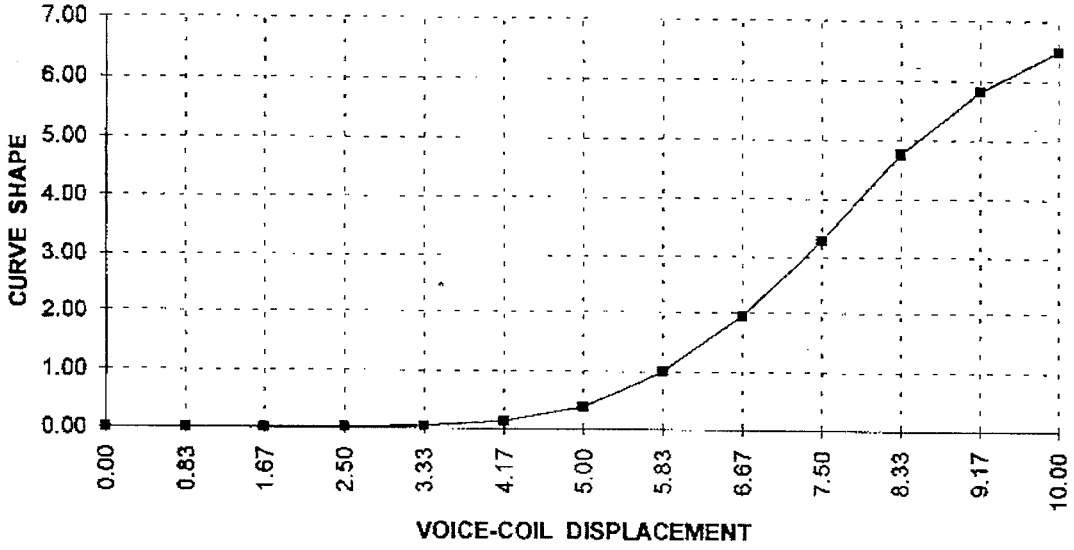

SMART AMPLIFIER FOR LOUDSPEAKER MOTIONAL FEEDBACK DERIVED FROM LINEARIZATION OF A NONLINEAR MOTION RESPONSIVE SIGNAL

FIELD OF THE INVENTION

This invention relates to a smart amplifier to provide an economical motional feedback loudspeaker system for obtaining acceptable bass performance even with smaller less expensive drivers and enclosures. This is achieved by the reduction of distortion with the use of feedback derived from a displacement responsive linearization of the back emf generated by the motion of the voice-coil within the magnet field.

BACKGROUND OF THE INVENTION

In the art of audio sound reproduction it is well-known that the dynamic loudspeaker is more nonlinear and generates more distortion than all the other system components combined. This problem is particularly severe with smaller less expensive speakers at low frequencies which require large volume velocities and long cone excursions. As the cone displacement increases the stiffness of both the inner spider and the outer surround increases rapidly resulting in a nonlinear suspension compliance generating high distortion. Another major source of loudspeaker distortion is the nonuniformity of flux density in the magnet gap and the resulting decrease in the BL force factor as the voice-coil moves from its initial rest position.

For example, in a typical small inexpensive sound system at a frequency of about 50 Hz the total harmonic distortion of the amplifier might be of the order of 0.5%, whereas the distortion of the loudspeaker might well exceed 50.0%, depending upon the loudness. That is, the amplifier is almost linear, whereas the loudspeaker is extremely nonlinear with gross distortion quite evident to the ear. This vast difference is due in large part to the fact that the amplifier distortion is reduced by a large amount of negative feedback, whereas the conventional loudspeaker has no feedback whatever.

DESCRIPTION OF THE PRIOR ART

It has long been recognized in the art that if negative feedback could be applied around the loudspeaker in an effective and economical manner then the present marginal fidelity of the loudspeaker might be greatly improved so as to approach the nearly perfect fidelity of the amplifier. There have been several different approaches in an attempt to correct loudspeaker distortion by the application of motional feedback so as to include the loudspeaker within the feedback loop. One approach generates the motional feedback signal by an accelerometer mounted on the speaker cone, and another approach generates the signal by an electromagnetic metal detecting device which senses the movement of the metallic wire constituting the speaker voice-coil. Both of these techniques are capable of substantial reduction of nonlinear distortion at very low frequencies, but are so expensive and limited in frequency range that they are used only in "high end" audiophile subwoofers.

Another scheme unsuccessfully attempted to generate the feedback signal by locating the speaker within a bridge network so as to sense the back emf (electromotive force) generated by the voice-coil moving within the magnetic field. In my U.S. Pat. No. 3,350,244 there is disclosed such a bridge arrangement wherein an overhung voice-coil within a conventional magnet structure was intended to provide an approximately constant number of effective field-cutting turns within the magnetic field as the voice-coil reciprocated during movement of the speaker cone. Also disclosing a motional feedback bridge arrangement is U.S. Pat. No. 3,889,060 to Goto et al.

Although this bridge scheme was economical, it failed to reduce significantly the nonlinear distortion of the sound radiated by the speaker and was not commercially successful. I believe that this failure was primarily due to the nonuniformity of the magnetic flux lines cut by the moving voice-coil and the resulting nonlinearity of the BL factor.

More particularly, the magnitude of the forward transfer function of a dynamic loudspeaker is determined in part by the following equation derived from Lorentz' law:

$$f=BLi$$

where f is the force driving the speaker cone, B is the magnetic flux density, L is the voice-coil conductor length immersed in the field, and i is the current through the voice-coil.

The magnitude of the induced back emf and hence the backward transfer function of the feedback system of said prior patents is determined by the following equation derived from Lenz' law:

$$emf=BLv$$

where emf is the back electromotive force or induced voltage from which the feedback signal is derived, B and L are as defined above, and v is the velocity of the voice-coil within the magnetic field. The product of the flux density B and the immersed length L of voice-coil conductor is known variously by such terms as the "BL factor", or the "force factor" or the "motive force". In conventional loudspeakers the voice-coil is overhung; that is, the axial length ("height") of the voice-coil is greater than the axial length or height of the cylindrical magnet gap, so that the opposite ends of the voice-coil project outwardly beyond the magnet gap. Due to the fringing effects of the magnetic flux at the ends of the gap the flux density varies along the axial length of the gap, and consequently the BL factor is not constant as the voice-coil moves axially within the gap.

This nonlinearity of the BL factor in conventional loudspeakers results in a nonlinearity in the forward transfer function and consequent generation of distortion in the radiated sound emitted from the cone, particularly at low frequencies which require large cone excursions. The level of distortion due to the nonlinearity of the forward transfer function is generally accepted as tolerable and unavoidable in conventional loudspeaker systems manufactured within constraints of cost. However if the back emf is utilized to generate a motional feedback signal then this nonlinearity of the BL factor, if uncorrected as in said prior patents, is far more deleterious than it is for the forward transfer function. This is because the nonlinearity in the backward transfer function of the feedback signal is fed to an input stage of the amplifier so that the distortion is greatly amplified. It is therefore critically important, and indeed essential, that the feedback signal be a substantially linear function of the loudspeaker cone motion.

Still another approach to motional feedback is the subject of my prior copending application Ser. No. 165,168, now U.S. Pat. No. 5,408,533, which discloses the use of an underhung voice-coil, preferably with a radially polarized magnet, so as to generate a linear back emf and thereby provide a motional feedback signal linearly related to the cone motion. This approach can provide a substantially linear feedback signal, but is disadvantageous in that it requires a unique speaker driver construction which is not readily available as a mass produced component and is therefore more expensive than conventional loudspeakers with overhung voice-coils.

OBJECTS OF THE INVENTION

It is therefore a primary object of the present invention to provide a motional feedback system having a novel circuit for linearizing a negative feedback signal derived from the back emf (electromotive force) induced by the axial reciprocal movement of the voice-coil within the magnetic field of the magnet gap.

Another important object is to provide an economical motional feedback system to enable acceptable bass response with less expensive speaker systems having small drivers and enclosures.

Still another important object of the present invention is to provide that the novel linearizing circuit compensate for the nonlinearity of the BL factor as the voice-coil undergoes displacement through magnet gap regions of varying flux density.

SUMMARY OF THE INVENTION

In the present invention a smart amplifier having a novel linearizing circuit corrects for the nonlinearity of the back emf voltage so that the resulting feedback signal accurately represents the voice-coil motion and so as to provide a feedback signal linearly proportional to either the velocity or acceleration of the speaker cone. The linear feedback signal is fed into an early stage of the amplifier so as to reduce the nonlinearity of the overall transfer function of the amplifier-speaker combination, including reduction of the harmonic and intermodulation distortion generated by the nonlinear suspension compliances of the speaker surround and spider. The result is an economical system with a substantial reduction in nonlinear distortion at low frequencies even with small inexpensive drivers and enclosures, as well as the other benefits of negative feedback such as reduced transient distortion and more uniform frequency response.

The term "smart amplifier" is coined herein to designate an amplification system which can detect the magnitude of the instantaneous cone motion without the aid of an accelerometer or other external transducer, and which can then generate a linear feedback signal corrected in accordance with the detected motion. More particularly, the smart amplifier of the preferred illustrative embodiment "knows" at every instant both the true displacement and true velocity of the cone, and also for every position of the cone it "knows" and applies the required correction of the back emf signal needed to compensate for the nonlinearity of the BL force factor, and the amplifier thereby generates a linearized motion responsive signal from which may be derived a feedback signal which is linearly proportional to the cone motion.

The disclosed illustrative embodiment of the present invention comprises a novel combination of an amplifier driving a feedback bridge network including a dynamic loudspeaker having a conventional magnet structure with an overhung voice-coil, in combination with a novel circuit for linearizing the feedback signal by compensating for the nonlinearity of the BL factor. An auxiliary amplifier has a feedback injection node and drives a power amplifier having an output terminal connected to the bridge network. The loudspeaker is drivingly connected within said bridge network and has a cone suspended for reciprocal motion and a voice-coil having a back electromotive force varying in response to the cone motion. The bridge network includes a pair of nodes having therebetween a voltage substantially proportional to the back electromotive force.

The disclosed illustrative embodiment further comprises a difference amplifier connected between said bridge nodes to sense the voltage difference and derive therefrom a motion responsive signal which is a nonlinear function of the velocity of the cone motion. A novel linearizing circuit is connected to the difference amplifier for linearizing the motion responsive signal so as to generate therefrom a feedback signal which is a substantially linear function of the cone velocity. A feedback network is connected from the linearizing circuit to the amplifier feedback injection node for transmitting the feedback signal.

In the disclosed illustrative embodiment the linearizing circuit comprises a multiplier for multipling the nonlinear motion responsive signal by a corrective function so as to generate a true velocity signal, an integrator for integrating the velocity signal to generate a true displacement signal, and a correction generator including curve shapers implemented by nonlinear amplifiers for generating the required corrective function in accordance with the magnitude of the displacement signal. The multiplier, integrator and correction generator thus constitute an inner feedback loop within the feedback path of the outer loop comprising the amplifier, loudspeaker and feedback network. This inner loop is recursive in the sense that the curve shapers generate a corrective function which provides a linear motional signal which drives the curve shapers to generate the corrective function.

DESCRIPTION OF THE DRAWINGS

In the accompanying drawings:

FIG. 5 is a graph of the BL factor plotted against the voice-coil displacement for a conventional dynamic loudspeaker driver with overhung voice-coil;

FIG. 6 is a graph of the BL factor of FIG. 5 which has been normalized to provide a plot of the BL distortion factor as a function of the voice-coil displacement;

FIG. 7 is a graph of the inverse of the distortion factor of FIG. 6 to provide a correction factor as a function of the cone displacement; and FIG. 8 is a graph of the correction factor function of FIG. 7 with the value of unity subtracted from the ordinate values to provide a curve shape to be generated by the curve shaper circuit as a function of the voice-coil displacement signal.

FIG. 9 is a flow chart showing the functions performed in the novel inner feedback loop for linearizing the nonlinear back emf signal induced by the movement of the voice-coil within the nonuniform magnetic flux density of the magnet gap.

DETAILED DESCRIPTION

Figure 1:
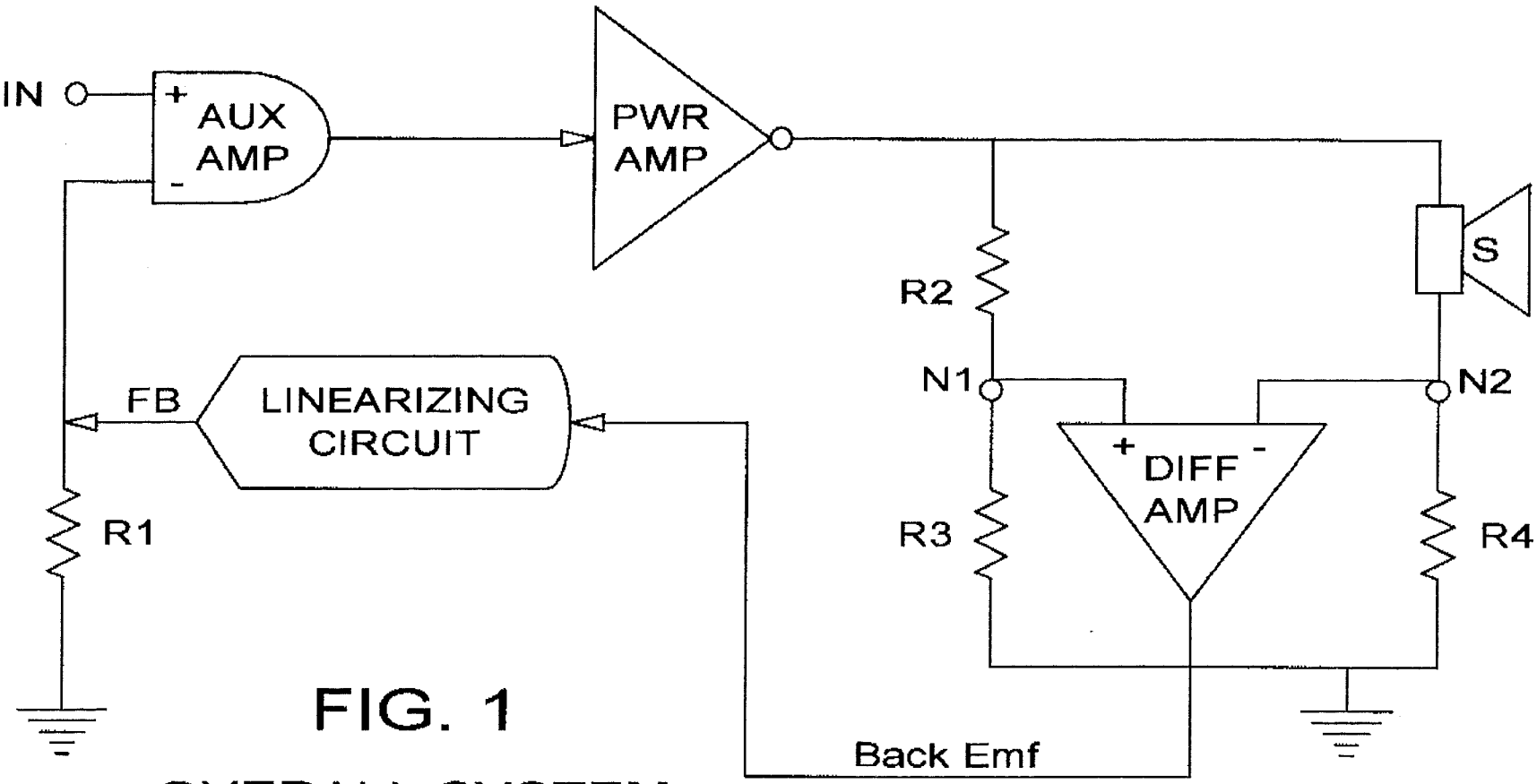
FIG. 1 is a schematic circuit diagram showing the overall system comprising amplifier circuitry, a speaker within a bridge network for generating a motion responsive signal, and a linearizing circuit for correcting the motion responsive signal to provide a linear feedback signal for injection into the amplifier circuitry.

Referring now to FIG. 1 in more detail, there is shown for purposes of illustration the overall motional feedback system in accordance with a preferred embodiment of the present invention. An auxiliary amplifier AUX AMP is connected in cascade with a conventional power amplifier PWR AMP driving a conventional loudspeaker S constituting one element of a bridge network also comprising resistors R2,R3 and R4. A difference amplifier designated DIFF AMP senses the voltage difference across the nodes N1, N2 of the bridge to generate a motion responsive signal which is transmitted to the LINEARIZING CIRCUIT.

The input terminal IN is connected to the noninverting input of the auxiliary amplifier AUX AMP. The inverting input of the latter is connected to ground through resistor R1. The output of auxiliary amplifier AUX AMP is connected to the input of power amplifier PWR AMP having its output connected to one terminal of speaker S having its other terminal connected at node N2 to the upper end of resistor R4. The lower end of the latter is connected to ground. The other two resistors R2 and R3 of the bridge are connected at node N1 and in series between the output of power amplifier PWR AMP and ground.

For low frequency applications the inductance of the speaker voice-coil is negligible and the blocked voice-coil impedance (when the cone is stationary) is effectively merely resistive without a substantial reactive component. For these low-frequency applications the bridge impedance elements R2,R3 ,R4 may be resistors since these would be capable of balancing the resistive voice-coil. However, if it is desired to use the present feedback system at higher frequencies where the inductance of the voice-coil becomes significant then one or more of the bridge impedance elements may include a reactance component, such as an inductor in series with resistor R4 or a capacitor in parallel with resistor R3.

The bridge comprising resistors R2, R3 and R4 and speaker S would be substantially balanced if movement of the speaker cone were blocked, and there would then be no significant voltage difference across the bridge between the node N1 at the junction of resistors R2,R3 and the opposite node N2 at the junction of the speaker S and resistor R4, notwithstanding the voltage swing at the output of power amplifier PWR AMP. That is, the ratio of the resistance of R2 to that of R3 is equal to the ratio of the speaker voice-coil resistance to that of R4. For example, in low-frequency applications the ratio of the resistance of R2 to that of R3 may be 10:1, and the ratio of the D.C. resistance of the voice-coil to the resistance of R4 would then also be 10:1

However, the speaker cone and voice-coil are free to move, and the motion of the voice-coil within the magnetic field of the magnet gap generates a back emf (electromotive force) which effectively raises the impedance of the voice-coil so as to unbalance the bridge. The resulting voltage difference across the bridge at nodes N1,N2 is sensed by difference amplifier DIFF AMP which transmits this voltage difference as a motion responsive signal.

If the speaker BL factor (flux density B times effective voice-coil wire length L) were constant throughout the movement of the voice-coil then the back emf and hence the motion responsive signal would be linearly related to the velocity of the speaker cone. This linearity is critically important to the effectiveness of the feedback to reduce the speaker distortion, since any nonlinearity in the feedback signal will be amplified and fed to the speaker as a distortion of the original signal. However, the BL factor of conventional overhung speaker drivers is not constant but instead falls off substantially as the voice-coil moves in either direction from its central quiescent position. This is illustrated in FIG. 5 which is a graph showing the BL factor of a typical speaker plotted against the voice-coil displacement within the magnet gap. This nonlinearity of the BL factor as a function of voice-coil displacement results in an induced back emf which is a nonlinear function of the cone motion, and the generated motion responsive signal at the output of difference amplifier DIFF AMP is also nonlinear and does not accurately represent the movement of the cone.

That is, the motion responsive signal is a distortion of the true cone velocity. This distortion may be characterized as a "distortion factor" which can be obtained by a normalization of the BL curve of FIG. 5. This distortion factor plotted as a function of voice-coil displacement is shown in FIG. 6. The primary object of the present invention is to provide a novel linearizing circuit to correct this distortion so as to provide a linear motion responsive signal which accurately represents the true cone motion and which may be utilized to generate a feedback signal.

The function of the linearizing circuit may be seen in connection with FIG. 7 which shows the curve of the mathematically ideal correction factor required to correct the distortion of the motion responsive signal due to the nonlinear BL factor. This correction factor is a function of the cone displacement and is obtained by generating the inverse (reciprocal) of the distortion factor shown in FIG. 6. The nonlinear motion responsive signal at the output of the difference amplifier DIFF AMP is multiplied by this correction factor so as to result in a product signal which at any instant has a value which is a sufficiently accurate measure of the instantaneous velocity of the voice-coil.

Figure 2:
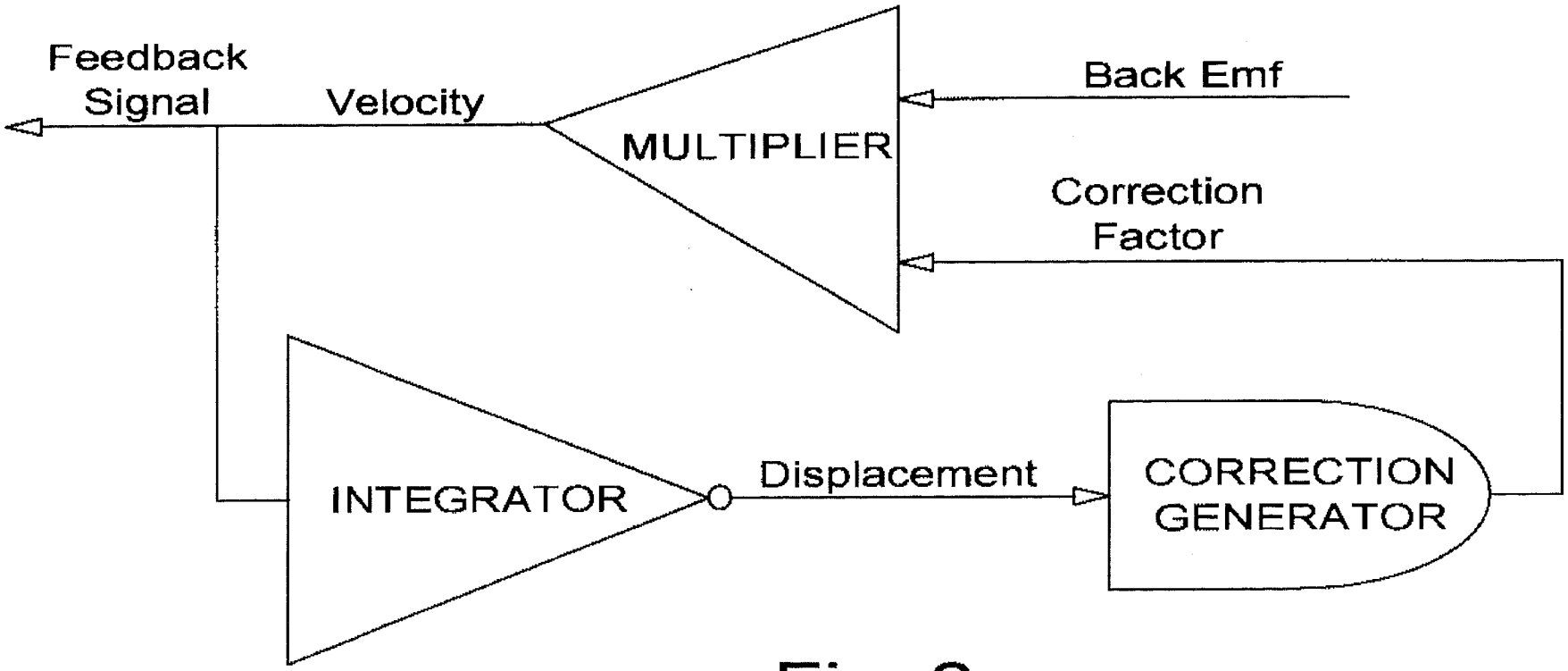
FIG. 2 is a schematic diagram showing a preferred illustrative embodiment of the linearizing circuit including the correction generator.

The novel circuit for generating this correction factor is shown in FIG. 2. The nonlinear back emf at the output of difference amplifier DIFF AMP (FIG. 1) is shown in FIG. 2 as transmitted to one of the inputs of a first processor designated MULTIPLIER. The required linearizing correction factor is fed to the other input of this multiplier processor. The signal at the output of the latter will be substantially linearly proportional to the actual cone velocity, if the correction factor has been properly generated.

This generation of the required proper correction factor is accomplished by a novel recursive feedback loop whereby the correction factor used to generate the true velocity signal is derived from this very velocity signal that the correction factor generated. More specifically, the velocity signal at the output of the processor designated MULTIPLIER is fed to a second processor designated INTEGRATOR which integrates the velocity signal to derive a displacement signal which is substantially linearly proportional to the true instantaneous displacement of the voice-coil and cone. This displacement signal is then transmitted to the input of a third processor designated CORRECTION GENERATOR which outputs, as a function of the instantaneous cone displacement, a sufficiently accurate approximation of the ideal required correction factor plotted in FIG. 7.

This recursive feedback loop utilizes a novel technique which may be described as a "self-fulfilling assumption". That is, the correction factor shown in FIG. 2 is "assumed" to be a function which is substantially the inverse of the distortion factor representing the nonlinearity of the BL force factor as a function of the displacement. In other words, this correction factor function is "assumed" to be such that when multiplied by the back emf signal the resulting product provides a corrected linearized signal which represents the true cone velocity with sufficient accuracy. The true cone velocity signal is then integrated to provide a displacement signal which represents the magnitude of the true cone displacement. This displacement signal is then processed by the correction generator to generate the originally "assumed" correction factor function, thereby fulfilling the initial "assumption". As a result, the corrective factor function and the displacement signal are each recursively derived from the other. This recursive technique is implemented by a novel inner feedback loop within the feedback path of the outer feedback loop of the overall system.

Figure 3:
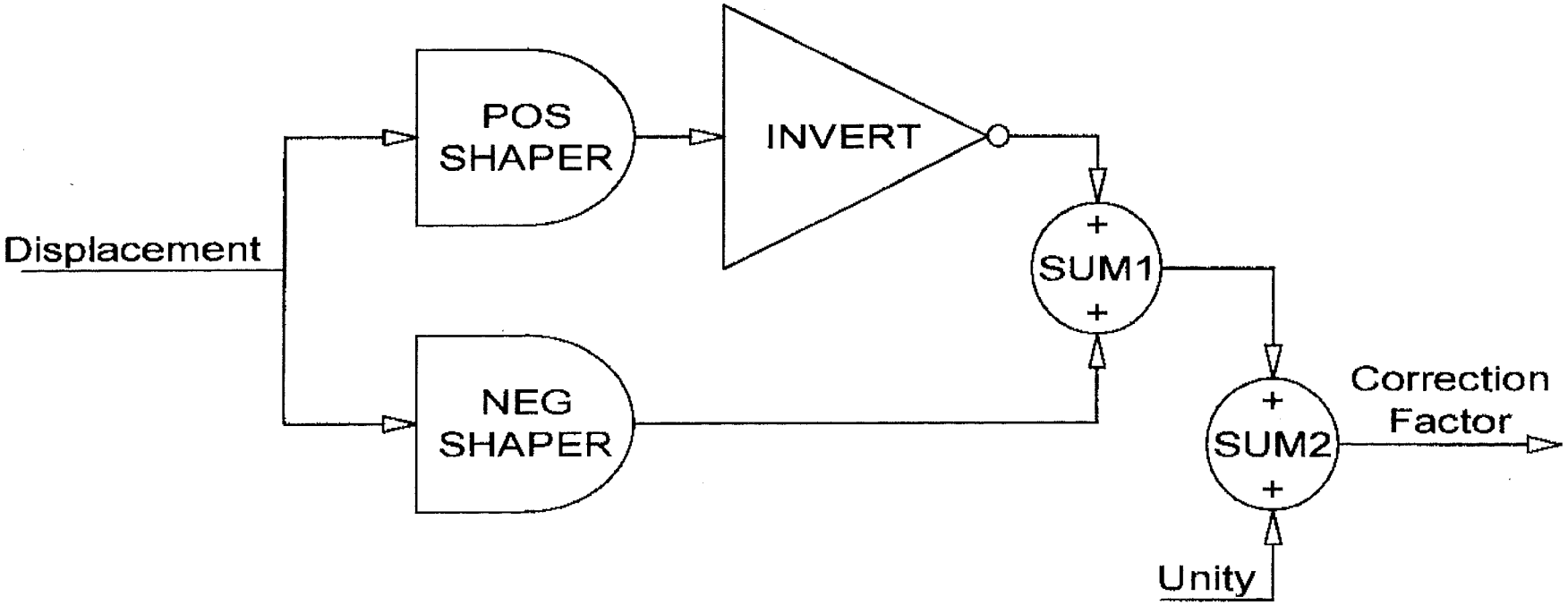
FIG. 3 is a schematic diagram showing a preferred illustrative embodiment of the correction generator including the curve shaper.

The processor designated CORRECTION GENERATOR is shown in FIG. 3 and comprises a positive curve shaper circuit POS SHAPER and a negative curve shaper circuit NEG SHAPER. Both polarities of curve shaper are required because each shaper is unipolar with one shaper handling positive going signals and the other negative signals. As will be described below, each curve shaper is preferably implemented as a nonlinear amplifier with a gain which increases with the input signal amplitude at a successively increasing rate required to generate the correction factor curve as a function of voice-coil displacement. The preferred curve shaper circuits have inverted output signals. In order that the final output of the correction generator be positive, the output of the positive shaper circuit POS SHAPER is fed to an inverter circuit designated INVERT and the output of the latter is added to the output of the negative shaper circuit NEG SHAPER in a first summing circuit designated SUM1. The output of the latter as a function of voice-coil displacement is plotted in FIG. 8 for positive displacement signals. Since most conventional speaker drivers have a different BL nonlinearity when the cone moves in one direction than when the cone moves in the opposite direction, the ngative and positive curve shaper circuits may be designed with appropriately different parameters, as will be explained below. In order to convert the shaper output signal of FIG. 8 to the required correction factor of FIG. 7, the value of unity is added to the shaper output signal by a second summing circuit designated SUM2. The output of the latter is a sufficiently accurate approximation to the ideal correction factor.

Figure 4:
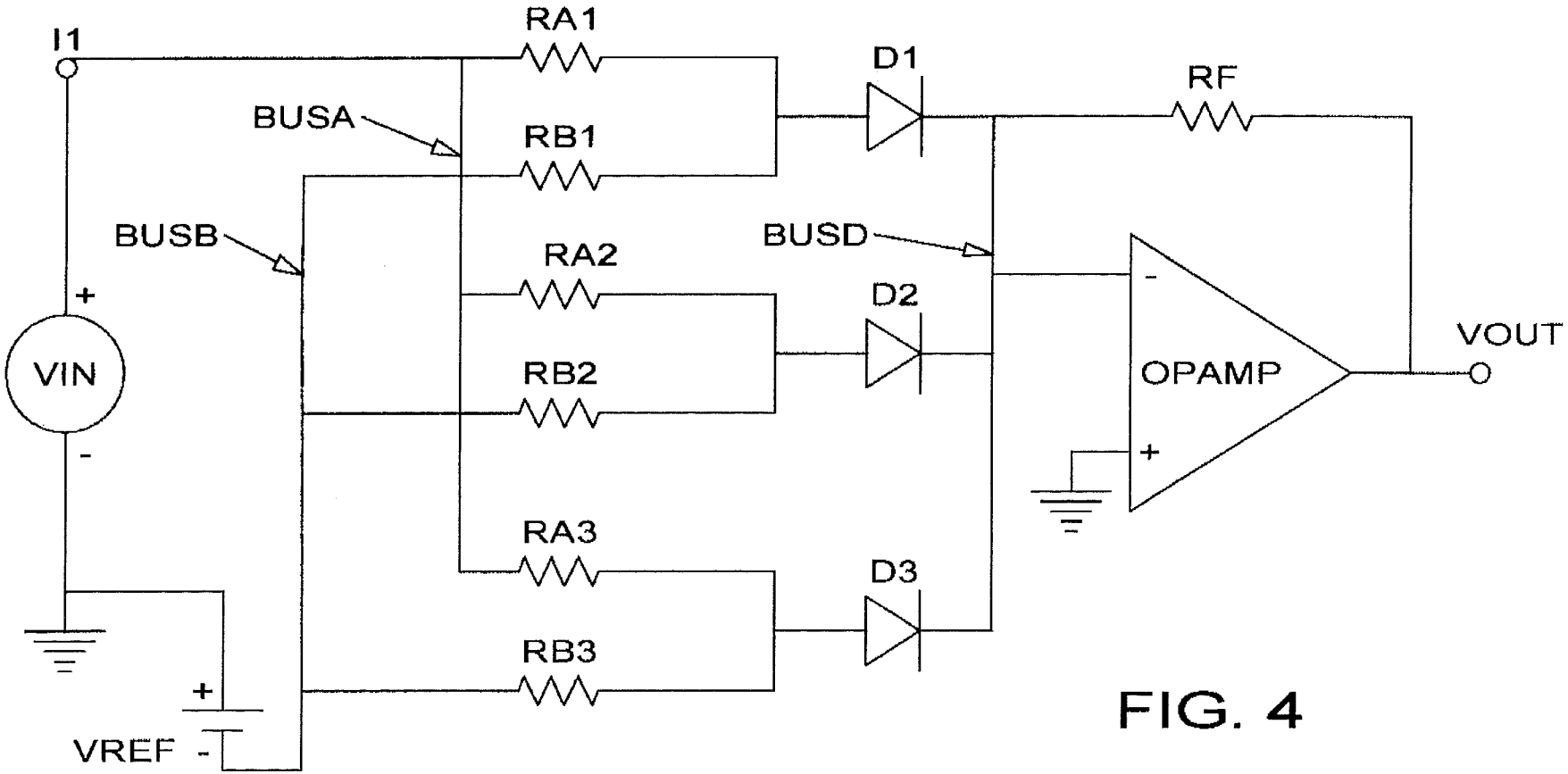
FIG. 4 is a schematic diagram showing a preferred illustrative embodiment of the curve shaper.

In FIG. 4 there is shown a preferred implementation of the curve shaper circuit. Although the drawing shows only the positive signal shaper, it will be explained below how the topology of the latter may be slightly modified to obtain a similar shaper circuit to handle the negative portions of the input displacement signal. This input signal is symbolized by the voltage source designated VIN extending between the input terminal I1 and ground. Input terminal I1 is connected to the uppper end of a vertical bus designated BUSA.

A first series of resistors RA1, RA2, RA3 is each connected at its left end to bus BUSA. A second series of resistors RB1, RB2, RB3 is each similarly connected to bus BUSB. The lower end of the latter is connected to the negative terminal of a constant d.c. voltage source designated VREF having its positive terminal grounded. The right ends of resistors RA1, RB1 are connected together at the anode of a first diode D1. Resistors RA2, RB2 are similarly connected to a second diode D2, and resistors RA3, RB3 are similarly connected to a third diode D3. The respective cathodes of diodes D1, D2, D3 are connected to a third vertical bus BUSD. Also connected to the latter are one end of a feedback resistor RF and the inverting input of an operational amplifier designated OPAMP. The noninverting input of the latter is grounded and its output terminal VOUT is connected to the other end of feedback resistor RF.

The curve shaper of FIG. 4 is a nonlinear amplifier which approximates the nonlinear function shown in FIG. 8 by a series of straight line segments tangential to that function, and operates as follows. Assume initially that the voice-coil displacement signal constituting the input voltage symbolized by VIN is at zero potential. Bus BUSA and the left ends of resistors RA1, RA2, RA3 will then be at ground potential. The inverting input of an operational amplifier is always substantially at zero potential and therefore bus BUSD and the cathodes of diodes D1, D2, D3 are at zero potential. Bus BUSB and thus the left ends of resistors RB1, RB2, RB3 are at the negative potential of voltage source VREF. As a result the voltage at the anodes of all three diodes D1, D2, D3 is at a negative level somewhere between the zero voltage of bus BUSA and the negative level of VREF and bus BUSB. All the diodes are therefore reverse biased and cut off, no current flows to the inverting input of the operational amplifier OPAMP, and its output voltage at VOUT is zero. As shown in FIG. 8, the output voltage will remain substantially zero until the input signal reaches a value corresponding to a voice-coil displacement of about 2.50 mm.

Now assume that the voltage of the input displacement signal increases positively. The design parameters of resistors RA1, RA2, RA3 were selected in relation to those of the respective resistors RB1, RB2, RB3 so that the following mode of operation will occur. The voltages at the anodes of diodes D1, D2, D3 will rise at different rates in response to the assumed increase in voltage at input I1 and bus BUSA. The values of resistors RA1 and RB1 were selected so that the anode of diode D1 is the first to reach the diode cutin voltage so that this diode is the first to become conductive. When diode D1 becomes fully conductive the gain of the operational amplifier OPAMP becomes equal to the ratio of the value of resistor RF to the value of resistor RA1. This gain value is the slope of the first straight line segment approximating the corresponding portion of the nonlinear curve shown in FIG. 8.

As the voice-coil displacement signal continues to increase in the positive direction eventually the anode of diode D2 will reach the cutin value and this diode will conduct. The current path through resistor RA2 and diode D2 will then be in parallel with the initial path through resistor RA1 and diode D1. The gain of the operational amplifier OPAMP is then determined by the ratio of resistor RF to the parallel combination of resistors RA1 and RA2. That is, the feedback around the operational amplifier OPAMP decreases and its gain increases. Hence the slope of the second straight line segment approximating this region of the curve in FIG. 8 will be greater than the slope of the first straight line segment and the plot curves concave upwardly as shown in the figure. Eventually the increase in the voice-coil displacement signal input to the curve shaper causes diode D3 to conduct and resistor RA3 is effecively placed in parallel with resistors RA1 and RA2, resulting in a further decrease in the feedback, a further increase in gain, and a further increase in the slope of the third straight line segment. If desired for critical applications, a more accurate approximation to the ideal correction factor may be obtained by adding more resistors and diodes to provide additional breakpoints and straight line segments.

For the particular ideal correction factor shown in FIG. 8 the curve shaper of FIG. 4 can approximate the curve fairly accurately until a voice-coil displacement of about 8 mm. where the correction factor function starts to reverse its curvature. This decrease in slope arises because for the particular BL factor shown in FIG. 5 the slope of the decline in the BL factor starts to level off when the displacement approaches the extreme limit. However, there are two compelling reasons why it would be disadvantageous to attempt to have a curve shaper attempt to follow the reverse curvature at the right end of the plot in FIG. 8. First, the particular curve shaper shown in FIG. 4 is inherently incapable of doing so, because as successive diodes reach their respective cutin values and start to conduct, the gain of the operational amplifier can only increase, and there is no way that the circuit as disclosed can reverse this process. Second, it is desirable, as the voice-coil and cone reach the limit of their displacement, that there be an increase in feedback so as to effectively brake the cone motion and thereby prevent the cone excursion from exceeding a safe limit beyond which damage to the speaker may occur, and also thereby prevent the amplifier from excessive clipping.

The negative curve shaper NEG SHAPER shown in FIG. 3 may be readily implemented by two slight modifications of the positive curve shaper implementation shown in FIG. 4. It is only necessary to reverse the directions of diodes D1, D2, D3 and to reverse the polarity of the constant d.c.voltage source VREF. Also, most conventional loudspeakers are asymmetrical in that the BL factor v. voice-coil displacement curve for cone motion in the positive or outward direction is different from that in the negative or rearward direction. It is therefore advantageous to design the curve shaper circuits with one set of values for the resistors and voltage source of the positive shaper and an appropriately different set of values for the negative shaper.

The method of designing the curve shaper of FIG. 4 is disclosed by Clayton et al. (Ref. 1 of the Bibliography appended to this specification). This reference also shows a modified topology for greater temperature stability of the breakpoints at which the successive straight line segments begin. Irvine (Ref. 2) shows another type of curve shaper utilizing reverse-biased zener diodes instead of the forward-biased diodes of the preferred embodiment of FIG. 4. Integrating circuits are disclosed in all four of the references in the bibliography. Multipliers are disclosed by Clayton et al. (Ref. 1) and also by Graeme et al. (Ref. 3).

MODIFIED EMBODIMENTS

For reasons of simplicity in illustration and economy of implementation the various functions such as multiplication, integration, curve shaping and addition are disclosed in the present preferred embodiment as implemented by analog components. These are available either over the counter or may be readily constructed with operational amplifier integrated circuits such as the ubiquitious 741 chips sold in all retail electronics parts stores. However, it will be understood by those skilled in the digital circuit art that these functions may be implemented instead by digital circuits rather than analog circuits. Continued advances in the new technology of ASIC (Application Specific Integrated Circuits) may make the digital approach more economical in the future, particularly for large volume manufacture.

If desired, an op amp circuit (not shown) as in said U.S. Pat. No. 3,889,060 may be employed to differentiate the linearized signal so as to obtain a feedback signal proportional to the cone acceleration which signal may then be injected into the feedback injection node at the noninverting input of auxiliary amplifier AUX AMP. This would obviate the need for an initial base-boost equalizer stage which would otherwise be required to compensate for the low-frequency rolloff of velocity feedback. However, this modification is less advantageous than the preferred embodiment because the differentiation operation amplifies the noise and distortion components of the feedback signal, and also produces phase shift which reduces the feedback stability margin of the overall system.

Other types of nonlinear amplifiers may be used to implement the curve shaper function. For example, the function may be generated in accordance with an algebraic polynomial of a variable representing the voice-coil displacement. Alternatively, the nonlinear amplifier may generate the distortion function rather than the correction function, and the nonlinear amplifier may be located in the feedback network of an operational amplifier so as to generate the inverse of this distortion function, so that the inverse may serve as the correction function.

It is to be understood that the embodiments disclosed herein are merely illustrative of several of the many forms which the invention may take in practice and that numerous modifications thereof will readily occur to those skilled in the art without departing from the invention as delineated in the appended claims which are to be construed as broadly as permitted by the prior art.

BIBLIOGRAPHY

1. Clayton, G. B. and Newby, B. W., Operational Amplifiers, Third edition, Butterworth-Heinemann, 1992.
2. Irvine, R. G., Operational Amplifier Characteristics and Applications, Prentice Hall, 1994.
3. Graeme, J. G., Tobey, G. E. and Huelsman, L. P., Operational Amplifiers, McGraw-Hill, 1971.
4. Wait, J. V., Huelsman, L. P. and Korn, G. A., Introduction to Operational Amplifier Theory and Applications, McGraw-Hill, 1992.

I claim:

1. A feedback linearizing circuit for use in a motional feedback loudspeaker system to convert a nonlinear motion responsive signal into a feedback signal which is a linear function of the loudspeaker cone motion, said linearizing circuit comprising a first processor for correcting said nonlinear motion responsive signal function in accordance with a corrective factor so as to generate a linearized signal which is a substantially linear function of said cone motion, a second processor for converting said linearized signal into a displacement signal which is a substantially linear function of the displacement of said loudspeaker cone during its motion, a third processor responsive to said displacement signal for generating said corrective factor as a function of said displacement signal, and means for deriving said feedback signal from said linearized signal.

2. A feedback linearizing circuit as set forth in claim 1 wherein said first processor comprises a multiplier for multiplying said nonlinear motion responsive signal by said corrective factor.

3. A feedback linearizing circuit as set forth in claim 1 wherein said linearized signal is a velocity signal proportional to the cone velocity, and said said second processor is an integrator for integrating said velocity signal to generate said displacement signal.

4. A feedback linearizing circuit as set forth in claim 1 wherein said third processor is a curve shaper for generating said corrective factor as a function of the magnitude of said displacement signal.

5. A feedback linearizing circuit as set forth in claim 1 wherein said first processor comprises a multiplier for multiplying said nonlinear motion responsive signal by said corrective factor, and said linearized signal is a velocity signal proportional to the cone velocity, said second processor is an integrator for integrating said velocity signal to generate said displacement signal, and said third processor is a curve shaper for generating said corrective factor as a function of the magnitude of said displacement signal.

6. A feedback linearizing circuit as set forth in claim 1 wherein said cone motion responsive signal is a function proportional to the cone motion multiplied by a distorting factor which is a nonlinear function of the cone displacement, and said corrective factor generated by said third processor is substantially the inverse of said nonlinear distorting factor.

7. A feedback linearizing circuit as set forth in claim 1 for use in a motional feedback system having an outer feedback loop including an amplifier, a loudspeaker and a feedback return path for injecting said feedback signal into said amplifier, said feedback linearizing circuit further comprising an inner feedback loop within said feedback return path of said outer loop and including said first processor, said second processor and said third processor.

8. A feedback linearizing circuit as set forth in claim 1 wherein said motion responsive signal is a nonlinear velocity signal which is a nonlinear function of the velocity of said cone and is proportional to the actual cone velocity multiplied by a distorting factor which is a nonlinear function of the cone displacement, said first processor is a multiplier for multiplying said nonlinear velocity signal by said corrective factor to provide a linear velocity signal which is linearly proportional to the cone velocity, said second processor is an integrator for integrating said linear velocity signal to provide said displacement signal, and said corrective factor generated by said third processor is substantially the inverse of said distorting factor function.

9. A feedback linearizing circuit for use in a motional feedback loudspeaker system for processing a nonlinear motion responsive back-emf signal so as to compensate for the nonlinearity of the loudspeaker BL force factor and thereby convert said nonlinear back-emf signal into a linearized negative feedback signal which is a linear function of the loudspeaker cone motion thereby to reduce the harmonic and intermodulation distortion generated by the loudspeaker, said linearizing circuit comprising processing means for correcting the nonlinearity of said nonlinear back-emf signal so as to generate therefrom a motion responsive signal which is a linear function of the instantaneous motion of said loudspeaker cone, and means for deriving said feedback signal from said linearized negative motion responsive signal.

10. In combination, a feedback linearizing circuit as set forth in claim 9 and a motional feedback system comprising amplification means having a feedback injection node and a power output terminal, an impedance network, a dynamic loudspeaker drivingly connected to said output terminal and to said impedance network and having a cone suspended for reciprocal motion, said loudspeaker having an impedance varying in response to said cone motion, said network having a node voltage responsive to the impedance of said loudspeaker, a sensing circuit for sensing said node voltage to derive a cone motion responsive signal which is a nonlinear function of said cone motion, said feedback linearizing circuit being connected to said sensing circuit for linearizing said cone motion responsive signal so as to generate therefrom a feedback signal which is a substantially linear function of said cone motion, and a feedback network connected to said correction circuit and said feedback injection node for transmitting said feedback signal to said injection node.

11. A motional feedback system as set forth in claim 10 wherein said correction circuit comprises a first processor for correcting said nonlinear motion responsive signal in accordance with a corrective factor so as to generate a feedback signal which is a substantially linear function of said cone motion, a second processor for converting said linear feedback signal into a displacement signal which is a substantially linear function of the displacement of said loudspeaker cone during its motion, and a third processor responsive to said displacement signal for generating said corrective factor in accordance with the magnitude of said displacement signal.

12. A motional feedback system as set forth in claim 11 wherein said cone motion responsive signal is a nonlinear function of the velocity of said cone, said feedback signal is a substantially linear function of the velocity of said cone, and said second processor is an integrator for integrating said feedback signal to provide said displacement signal.

13. A motional feedback system as set forth in claim 11 wherein said cone motion responsive signal is a function proportional to the cone motion multiplied by a distorting factor which is a nonlinear function of the cone displacement, and said corrective factor generated by said third processor is substantially the inverse of said distorting factor.

14. A motional feedback system as set forth in claim 11 wherein said amplifier, loudspeaker and a feedback network constitute an outer feedback loop, said correction circuit comprising an inner feedback loop within said feedback network and said inner loop including said first processor, said second processor and said third processor.

15. A motional feedback system as set forth in claim 11 wherein said cone motion responsive signal is a function proportional to the velocity of said cone multiplied by a distorting factor which is a nonlinear function of the cone displacement, said feedback signal is a substantially linear function of the cone velocity, and said second processor is an integrator for integrating said feedback signal to provide said displacement signal, said corrective function generated by said third processor is substantially the inverse of the nonlinear function of said distorting factor, said amplifier, loudspeaker and a feedback network constituting an outer feedback loop, said first processor, said second processor and said third processor together constituting an inner feedback loop within said feedback network.

16. A feedback linearizing circuit as set forth in claim 9 wherein said processing means comprises first means for correcting said nonlinear back-emf signal in accordance with a corrective factor so as to generate a linearized motion responsive signal which is a substantially linear function of the instantaneous motion of the loudspeaker cone, and second means for processing said linearized motion responsive signal so as to generate said corrective factor.

17. A feedback linearizing circuit as set forth in claim 16 wherein said first means generates a linearized velocity signal which is a substantially linear function of the instantaneous velocity of the loudspeaker cone, and said second means processes said linearized velocity signal so as to generate said corrective factor.

18. A feedback linearizing circuit as set forth in claim 17 wherein said second means comprises means for converting said linearized velocity signal into a displacement signal which is a linear function of the cone displacement, and means for generating said corrective factor in accordance with the instantaneous magnitude of said displacement signal.

19. A motional feedback system comprising a feedback linearizing circuit as set forth in claim 9 and a loudspeaker, said loudspeaker having a magnet gap with a nonuniform magnetic field with a nonuniform flux density B with regions of said field having a predetermined flux density and other regions thereof having a reduced flux density less than said predetermined flux density, said loudspeaker having a voice-coil with coil turns of a total length L immersed within said magnetic field and attached to said cone for reciprocal displacement therewith, said back electromotive force is a function of the loudspeaker BL factor consisting of the product of said flux density B and said length L of immersed coil turns, said back electromotive force is a nonlinear function of the cone velocity due to a reduction in said BL factor as the voice-coil is displaced in a direction toward either end of the magnet gap so as to extend within said regions of reduced flux density, whereby said BL factor reduction varies as a function of the instantaneous cone displacement, and said linearizing circuit providing a corrective function which is substantially the inverse of said BL factor reduction function.

20. A feedback linearizing circuit as set forth in claim 9 wherein said processing means comprises first processor means for correcting said nonlinear motion responsive back-emf signal in accordance with a corrective factor which is a function of the magnitude of the cone displacement so as to generate a linearized velocity signal which is a substantially linear function of the velocity of the loudspeaker cone, second processor means for converting said linearized velocity signal into a displacement signal which is a substantially linear function of the magnitude of the displacement of said loudspeaker cone during its motion, and third processor means responsive to said displacement signal for generating said corrective factor as a function of the magnitude of said displacement signal, whereby said linearizing circuit generates a linear displacement signal converted from said velocity signal which is in turn corrected and linearized in accordance with said displacement signal, so that each of these signals is recursively derived from the other.

21. A motional feedback system comprising a feedback linearizing circuit as set forth in claim 20 and a loudspeaker, said loudspeaker having a magnet gap with a nonuniform magnetic field with a nonuniform flux density B with regions of said field having a predetermined flux density and other regions thereof having a reduced flux density less than said predetermined flux density, said loudspeaker having a voice-coil with coil turns of a total length L immersed within said magnetic field and attached to said cone for reciprocal displacement therewith, said back electromotive force is a function of the loudspeaker BL factor consisting of the product of said flux density B and said length L of immersed coil turns, said back electromotive force is a nonlinear function of the cone velocity due to a reduction in said BL factor as the voice-coil is displaced in a direction toward either end of the magnet gap so as to extend within said regions of reduced flux density, whereby said BL factor reduction varies as a function of the instantaneous cone displacement, and said linearizing circuit providing a corrective function which is substantially the inverse of said BL factor reduction function.

22. In combination, a linearizing feedback circuit as set forth in claim 20, and a motional feedback system comprising amplification means having a feedback injection node and a power output terminal, a bridge network, a dynamic loudspeaker drivingly connected within said bridge network and to said output terminal and having a cone suspended for reciprocal motion, said loudspeaker including a voice-coil having a back electromotive force varying in response to said cone motion, said bridge network including a pair of nodes having therebetween a voltage substantially proportional to said back electromotive force, a difference amplifier connected between said bridge nodes to sense said voltage therebetween and derive therefrom a motion responsive signal which is a nonlinear function of the velocity of said cone motion, said feedback linearizing circuit being connected to said difference amplifier for linearizing said motion responsive signal so as to generate therefrom a velocity signal which is a substantially linear function of said velocity of said cone motion, and feedback network means connected to said linearizing circuit and to said feedback injection node for transmitting to said injection node a feedback signal which is a substantially linear function of said cone motion.

23. A motional feedback system as set forth in claim 22 wherein said loudspeaker has a magnet gap with a nonuniform magnetic field with a nonuniform flux density B with regions of said field having a predetermined flux density and other regions thereof having a reduced flux density less than said predetermined flux density, said loudspeaker having a voice-coil with coil turns of a total length L immersed within said magnetic field and attached to said cone for reciprocal displacement therewith, said back electromotive force is a function of the loudspeaker BL factor consisting of the product of said flux density B and said length L of immersed coil turns, said back electromotive force is a nonlinear function of the cone velocity due to a reduction in said BL factor as the voice-coil is displaced in a direction toward either end of the magnet gap so as to extend within said regions of reduced flux density, whereby said BL factor reduction varies as a function of the instantaneous cone displacement, and said linearizing circuit provides a corrective function which is substantially the inverse of said BL factor reduction function.

24. A motional feedback system as set forth in claim 23 wherein said linearizing circuit includes means for increasing said nonlinear motion responsive signal in accordance with said corrective function to provide a corrected motion responsive signal which is substantially linearly proportional to the instantaneous velocity of said cone.

25. A smart amplifier having a motional feedback linearizing circuit for processing a nonlinear motion responsive signal having instantaneous values which deviate from those proper values which would accurately depict the motion of a loudspeaker cone, said linearizing circuit comprising first means for determining an attribute of the cone motion from which may be determined at each instant the magnitude of the error deviation of the nonlinear motion responsive signal from that proper value which would accurately depict the cone motion, second means responsive to said first means for compensating said nonlinear motion responsive signal so as to correct for said deviation and thereby substantially linearize said motion responsive signal so that the latter substantially accurately depicts the instantaneous motion of the loudspeaker cone, and third means for deriving a feedback signal from said linearized motion responsive signal.

26. A smart amplifier as set forth in claim 25 wherein the nonlinearity of said motion responsive signal is a function of the cone displacement, said first means including means for determining the cone displacement at each instant, and said second means including means responsive to the magnitude of the cone displacement to correct said motion responsive signal in accordance therewith.

27. A smart amplifier as set forth in claim 26 wherein said second means includes means for generating a velocity signal which substantially accurately depicts the instantaneous velocity of the cone, said first means including means for integrating said velocity signal to derive said displacement signal.

* * * * *